US009455492B2

(12) United States Patent
Jiang

(10) Patent No.: US 9,455,492 B2
(45) Date of Patent: Sep. 27, 2016

(54) MULTIBAND ANTENNA ARRANGEMENT

(71) Applicant: Hua Jiang, Shenzhen (CN)

(72) Inventor: Hua Jiang, Shenzhen (CN)

(73) Assignee: AAC Technologies Pte. Ltd., Singapore (SG)

( * ) Notice: Subject to any disclaimer, the term of this patent is extended or adjusted under 35 U.S.C. 154(b) by 85 days.

(21) Appl. No.: 14/597,379

(22) Filed: Jan. 15, 2015

(65) Prior Publication Data

US 2016/0064802 A1 Mar. 3, 2016

(30) Foreign Application Priority Data

Aug. 26, 2014 (CN) ..... 2014 2 0484886 U

(51) Int. Cl.
*H01Q 1/24* (2006.01)
*H01Q 5/307* (2015.01)
*H01Q 5/20* (2015.01)

(52) U.S. Cl.
CPC ..... *H01Q 1/243* (2013.01); *H01Q 5/20* (2015.01); *H01Q 5/307* (2015.01)

(58) Field of Classification Search
CPC ..... H01Q 1/243; H01Q 5/20; H01Q 5/307
USPC ..... 343/700 MS, 702, 725, 727, 829, 846
See application file for complete search history.

(56) References Cited

U.S. PATENT DOCUMENTS

| | | | | |
|---|---|---|---|---|
| 7,532,168 | B2 * | 5/2009 | Nakanishi | H01Q 1/243 343/702 |
| 8,217,853 | B2 * | 7/2012 | Tai | H01Q 1/22 343/700 MS |
| 8,264,412 | B2 * | 9/2012 | Ayala | H01Q 1/2266 343/700 MS |
| 8,836,587 | B2 * | 9/2014 | Darnell | H01Q 1/243 343/700 MS |
| 2011/0316751 | A1 * | 12/2011 | Jarvis | H01Q 1/243 343/702 |
| 2014/0354487 | A1 * | 12/2014 | Liang | H01Q 1/243 343/702 |

* cited by examiner

*Primary Examiner* — Tho G Phan
(74) *Attorney, Agent, or Firm* — Na Xu; IPro, PLLC

(57) ABSTRACT

A multiband antenna arrangement is disclosed. The multiband antenna arrangement includes a metallic shell forming an rectangular outer appearance and including a metallic top shell acting as a radiating element of antenna, a printed circuit board, a WIFI antenna, a diversity antenna having a grounded point and a feeding point electrically connecting the radiating element of the metallic top shell, a GPS antenna far away from the diversity antenna and having a grounded point and a feeding point electrically connecting the radiating element of the metallic top shell, the grounded point of the diversity antenna and the grounded point of the GPS antenna both positioned between the feeding point of the diversity antenna and the feeding point of the GPS antenna.

16 Claims, 3 Drawing Sheets

MULTIBAND ANTENNA ARRANGEMENT

RELATED PATENT APPLICATIONS

This application claims the priority benefit of Chinese Patent application Filing Serial Number CN 201420484886.7, filed on Aug. 26, 2014, the disclosures of which are herein incorporated by reference in its entirety.

FIELD OF THE INVENTION

The present disclosure generally relates to antennas for wireless communications devices, and more particularly to multiband antenna arrangements for improving isolation.

DESCRIPTION OF RELATED ARTS

Modern mobile phone handsets and other portable devices typically incorporate an internal antenna, such as a Planar Inverted-F Antenna (PIFA) or other planar antenna, or similar. Planar inverted F-antennas in mobile terminals are used to cover an increasing number of communications bands, such as CDMA850, GSM900, GSM1800, PCS1900, and UMTS2000. At the same time, the size of mobile terminals has been reduced dramatically. The miniaturization of mobile terminals leaves ever less space for the antenna. However, there are the fundamental limits on bandwidth as a function of antenna volume. Generally speaking, the smaller size the antenna has, the narrower bandwidth performs.

In addition, modern handheld devices are required to cover an increasing number of communications systems. Therefore, more than one antenna has been or will be introduced into handheld devices, for example cellular antenna, Bluetooth antenna, mobile TV antenna, and WLAN antenna. To minimize the interference among the antennas, the antennas need to be positioned as far as possible from each other. However, as the size of mobile terminals has been reduced dramatically, the miniaturization of mobile terminals leaves ever less space for the antennas.

Also, as an interest in a design of a terminal increases and the terminal becomes smaller and lighter, a problem that the performance of an internal antenna is lowered as compared to an external antenna is caused. Thus, the mobile terminal is equipped with a main antenna for transmission and reception, which is installed in the terminal for improvement of performance and smooth data communication, and a separate diversity antenna for preventing fading effect.

Antenna diversity is a well-known technique for mitigating the effects of multipath propagation in a wireless system. In general there are three types of antenna diversity techniques; pattern diversity, space diversity, and polarisation diversity. In all types, a receiver receives and combines input from two or more antennas. The antennas are "diverse" in that they are separated by a certain distance and/or have different polarisations or patterns. The diversity antenna has been developed to an antenna which can be easily installed even in a narrow space within a terminal body. Examples of the diversity antenna include a Planar Inverted F-Antenna (PIFA) having a sufficient distance more than X/2 from the main antenna, a meander antenna having a curved pattern, a loop antenna, an inverted F-antenna, a wire type antenna and the like.

However, many issues are associated with adoption of diversity antennas inside handheld devices. One is that the volume of diversity antennas is too large for modern compact handheld devices to achieve a high isolation and low cross-correlation coefficient, particularly in the GSM900/800 bands. An example of using polarisation diversity in antennas for lap top computers is shown in U.S. Pat. No. 6,518,929. This shows a single-plane antenna structure that provides the two separate polarisations needed for signal isolation. Polarisation separation is achieved using one antenna that is an electric field structure, such as a monopole antenna, adjacent to an antenna that is a magnetic field structure, such as a slot or loop antenna. The loop antenna will propagate primarily perpendicular to the plane of the loop, while the monopole antenna will propagate primarily parallel to the plane of the monopole. When the two different kinds of structures are placed in the same plane, the polarisations are orthogonal and provide the desired signal isolation.

For use of the conventional external antenna, lowering of antenna performance is not exhibited by virtue of a sufficiently spaced distance from the diversity antenna. However, for use of an internal main antenna which occupies more than a predetermined area of an inner space of the terminal, an isolation less than 5 dB is acquired due to an insufficiently space distance from the diversity antenna, causing the performance of the main antenna to be lowered due to interference with each other.

Further, with the development of communication technologies applied to mobile terminals, terminals supporting a dual mode or triple mode in addition to the conventional single frequency transmission and reception function are released, and various types of applications, such as CDMA, PCS, WCDMA, GSM, GPS, WIFI, Bluetooth, Long Term Evolution (LTE), Wimax functions are implemented in one terminal. Also, the size reduction of the terminal results in installing many antennas within a narrow space.

Terminals employing diversity antennas with different frequency bands cause difficulty in ensuring an installation space and a spaced distance for the diversity antennas, and the problem caused due to the interference between the antennas becomes worse.

So, it is necessary to provide an antenna apparatus which is capable of ensuring installation space and spaced distance and achieving higher efficiency may be taken into account.

BRIEF DESCRIPTION OF THE DRAWINGS

Many aspects of the embodiment can be better understood with reference to the following drawings. The components in the drawings are not necessarily drawn to scale, the emphasis instead being placed upon clearly illustrating the principles of the present disclosure. Moreover, in the drawings, like reference numerals designate corresponding parts throughout the several views.

DETAILED DESCRIPTION OF THE EXEMPLARY EMBODIMENT

Figure 1:
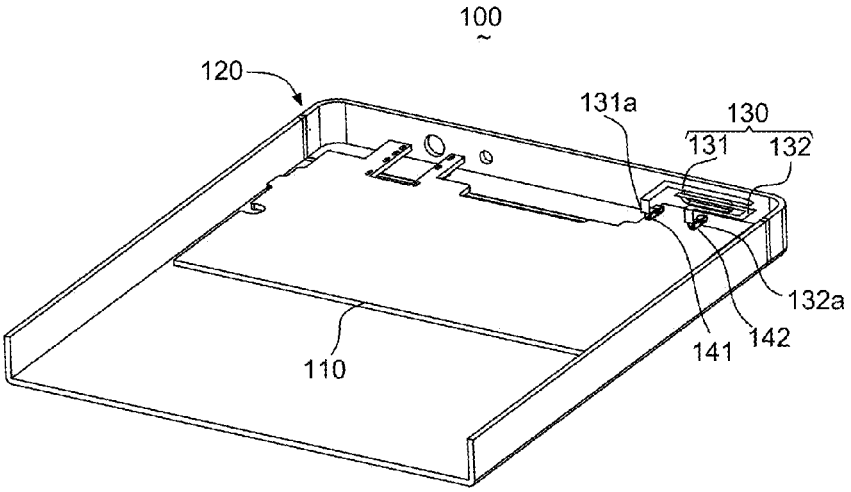
FIG. 1 is an isometric view of a multiband antenna arrangement in accordance with an exemplary embodiment of the present disclosure.

While the invention is susceptible of embodiment in many different forms, there is shown in the drawings and will herein be described in detail embodiment of the invention with the understanding that the present disclosure is to be considered as an exemplification of the principles of the invention and is not intended to limit the broad aspect of the invention to the embodiment illustrated.

Figure 2:
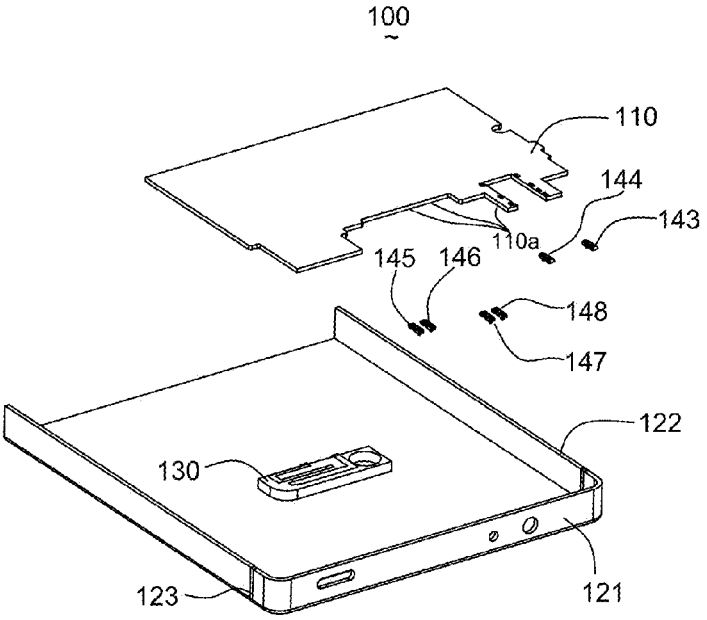
FIG. 2 is an isometric exploded view of the multiband antenna arrangement in FIG. 1.

Referring to FIGS. 1-2 illustrate a multiband antenna arrangement 100 in accordance with an exemplary embodiment of the present disclosure. The multiband antenna arrangement 100 may be a mobile phone, a smart phone, a notebook computer, a digital broadcast terminal, a Personal Digital Assistant (PDA), a Portable Multimedia Player (PMP) and the like. As shown in FIG. 1, the multiband antenna arrangement 100 has a metallic shell 120 used to be held by users, a printed circuit board 110 which is grounded, and a WIFI antenna 130.

Figure 3:
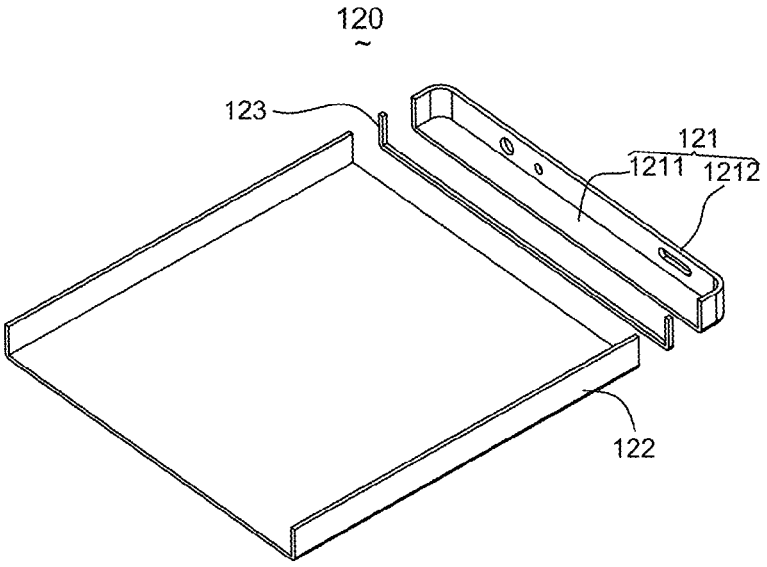
FIG. 3 is an isometric exploded view of a metallic shell of the multiband antenna arrangement in FIG. 1, with a PCB and a WIFI antenna thereof being removed away.

Referring to FIG. 3, the metallic shell 120 forming an rectangular outer appearance of the main body of a mobile terminal may be formed from a metallic top shell 121 and a metallic rear shell 122. An insulated intermediate shell 123 may further be disposed between the metallic top shell 121 and the metallic rear shell 122. A space formed by the metallic top shell 121 and the metallic rear shell 122 may accommodate various electronic components therein. Furthermore, the metallic top shell 121 includes a plane bottom 1211 connecting with the metallic rear shell 122 by the insulated intermediate shell 123, and a sidewall 1212 extending upwardly from the plane bottom 1211. Especially, the metallic top shell 121 is not only a portion of the metallic shell 120 of the mobile terminal, but also advantageously enhances antenna performance by acting as a radiating element at the operating frequency band.

Figure 4:
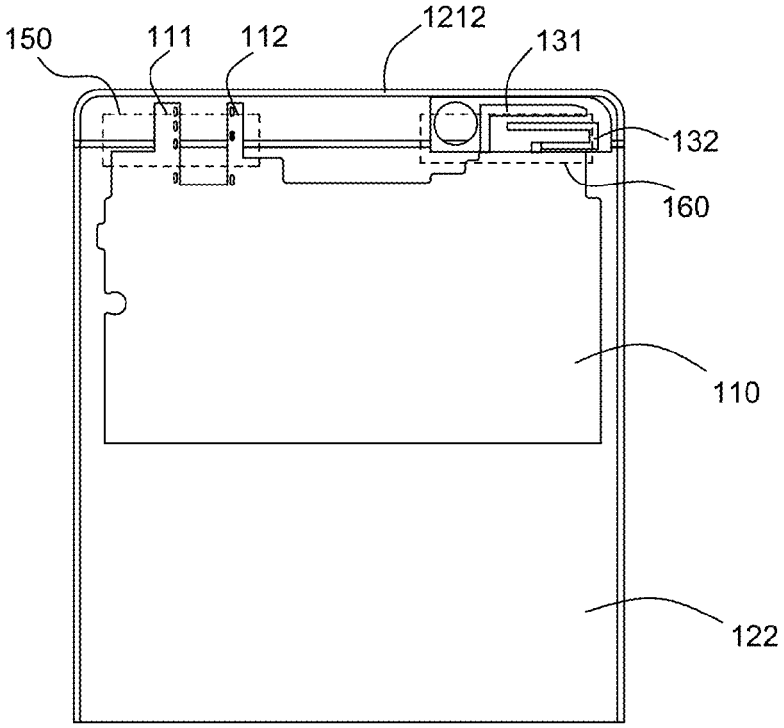
FIG. 4 is a top view of the multiband antenna arrangement in FIG. 1.
Figure 5:
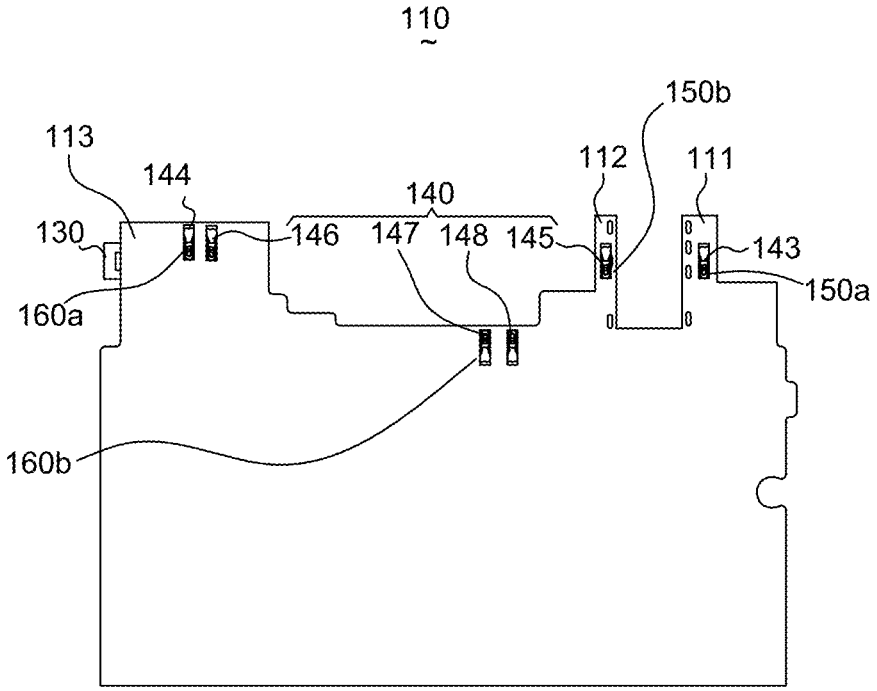
FIG. 5 is a back view of the multiband antenna arrangement in FIG. 4, with the metallic shell thereof being removed away.

Referring to FIGS. 3 through 5, the printed circuit board 110 includes a RF communication unit (not shown) with transceiver interfacing with the radiating element. The WIFI antenna 130 has a carrier which is formed with insulators such as polycarbonate, etc. installed in the metallic shell 120 of the mobile terminal, and an antenna radiator of a circuit pattern shape capable of performing wireless transmission and reception in a specific frequency band mounted on this carrier. In an exemplary design, the carrier may be implemented such that it occupies as little space and volume as possible, so that the WIFI antenna 130 can be as small as possible.

Specifically, the WIFI antenna 130 has a first branch 131 and a second branch 132 separated from the first branch 131, a first feeding point 132*a* disposed on the printed circuit board 110, and a ground point 131*a* of the WIFI antenna 130. In other words, the first branch 131 and the second branch 132 may be two radiating branches. The first branch 131 serves as a parasitic element which is positioned between the second branch 132 and the sidewall 1212 of the metallic shell 120 for coupling each other. The first branch 131 electrically connects with the printed circuit board 110 via a first elastic metallic plate 141 for electrically connecting the grounded point 131*a* of the WIFI antenna 130, and the second branch 132 electrically connects with the first feeding point 132*a* via a second elastic metallic plate 142.

In the embodiment, the printed circuit board 110 further includes three extending portions positioned right above the plane bottom 1211 of the metallic top shell 121. The three extending portions define a first extending portion 111, a second extending portion 112 and a third extending portion 113 far away from the first extending portion 111 and the second extending portion 112. The second extending portion 112 is provided between the first extending portion 111 and the third extending potion 113. The printed circuit board 110 further has a plurality of grounded points 110*a* for providing antenna.

In the embodiment, a diversity antenna 150 is provided and has a second feeding point 150*a* disposed on the first extending portion 111 of the printed circuit board 110, and one or more first grounded points 150*b* selected from the plurality of grounded points 110*a*. A third elastic metallic plate 143 is electrically connects the second feeding point 150*a* with the plane bottom 1211 of the metallic top shell 121. A GPS antenna 160 is provided and has a third feeding point 160*a* disposed on the third extending portion 111 of the printed circuit board 110, and one or more second grounded points 160*b* selected from the plurality of grounded points 110*a*. A fourth elastic metallic plate 144 is electrically connects the third feeding point 160*a* with the plane bottom 1211 of the metallic top shell 121.

For reducing the coupling of the diversity antenna 150 and GPS antenna 160, the first grounded point 150*b* and the second grounded point 160*b* both are positioned between the second feeding point 150*a* diversity antenna 150 and the third feeding point 160*a* of the GPS antenna 160. Furthermore, a plurality of elastic metals 140 corresponding to the plurality of grounded points 110*a* that are positioned between the plurality of grounded points 110*a* and the plane bottom 1211 of the metallic shell 120 for electrically connecting.

In the present embodiment, the amount of the plurality of grounded points 110*a* of the printed circuit board 110 are four. Specifically, the plurality of elastic metals 140 define a fifth elastic metallic plate 145 positioned on the second extending portion 112 of the printed circuit board 110 for electrically connecting first out of four grounded points, a sixth elastic metallic plate 146 positioned on the third extending portion 113 of the printed circuit board 110 for electrically connecting second out of four grounded points, a seventh elastic metallic plate 147 and a eighth elastic metallic plate 148 both positioned on the printed circuit board 110 and provided between the fifth elastic metal 145 and sixth elastic metallic plate 146 for electrically connecting third out of four grounded points and fourth out of four grounded points, respectively. In other words, the diversity antenna 150 and the GPS antenna 160 respectively select one grounded point from the plurality of grounded points 110*a* of the printed circuit board 110 so as to improve isolation between each other. FIG. 5 illustrates only four grounded points, but, the amount of the grounded points are not limited to four, and may be adjusted according to actual requirements.

While the present invention has been described with reference to a specific embodiment, the description of the invention is illustrative and is not to be construed as limiting the invention. Various of modifications to the present invention can be made to the exemplary embodiment by those skilled in the art without departing from the true spirit and scope of the invention as defined by the appended claims.

What is claimed is:

1. A multiband antenna arrangement, comprising:

a metallic shell forming an rectangular outer appearance and including a metallic top shell acting as a radiating element;

a printed circuit board having a plurality of grounded points;

a WIFI antenna defining a first branch, a second branch separated from the first branch, a first feeding point disposed on the printed circuit board, a first elastic metallic plate electrically connecting the first branch with one grounded point selected from the plurality of grounded points, and a second elastic metallic plate electrically connecting the second branch with the first feeding point;

a diversity antenna having a second feeding point disposed on the printed circuit board, a third elastic metallic plate for connecting the second feeding point with the metallic top shell, and one or more first grounded points selected from the plurality of grounded points;

a GPS antenna having a third feeding point disposed on the printed circuit board, a fourth elastic metallic plate for connecting the third feeding point with the metallic top shell, and one or more second grounded points selected from the plurality of grounded points;

the first and second grounded point positioned between the second feeding point and the third feeding point;

a plurality of elastic metals corresponding to the first and second grounded point provided between the first and second grounded point and the metallic top shell for electrically connecting the metallic top shell.

2. The multiband antenna arrangement as described in claim 1, wherein the metallic top shell includes a plane bottom and a sidewall extending upwardly from the plane bottom.

3. The multiband antenna arrangement as described in claim 2, wherein the first branch serves as a parasitic element which is positioned between the second branch and the sidewall of the metallic shell for coupling each other.

4. The multiband antenna arrangement as described in claim 3, wherein the printed circuit board further includes a first extending portion, a second extending portion and a third extending portion far away from the first extending portion and the second extending portion, the second extending portion provided between the first extending portion and the third extending potion.

5. The multiband antenna arrangement as described in claim 4, wherein the third elastic metallic plate is provided on the first extending portion of the printed circuit board, and the fourth elastic metallic plate is provided on the third extending portion of the printed circuit board.

6. The multiband antenna arrangement as described in claim 5, wherein the plurality of elastic metals define a fifth elastic metallic plate positioned on the second extending portion of the printed circuit board, a sixth elastic metallic plate provided on the third extending portion of the printed circuit board, a seventh elastic metallic plate and a eighth elastic metallic plate both positioned on the printed circuit board and provided between the fifth elastic metallic plate and sixth elastic metallic plate.

7. The multiband antenna arrangement as described in claim 6, wherein the metallic shell further includes a metallic rear shell and an insulated intermediate shell sandwiched between the metallic top shell and the metallic rear shell.

8. A multiband antenna arrangement, comprising:

a metallic shell forming an rectangular outer appearance and including a metallic top shell acting as a radiating element of antenna;

a printed circuit board having a plurality of grounded points;

a diversity antenna having a feeding point electrically connecting the metallic top shell, and one or more first grounded points selected from the plurality of grounded points and electrically connecting the metallic top shell;

a GPS antenna far away from the diversity antenna and having a feeding point electrically connecting the metallic top shell, one or more second grounded points selected from the plurality of grounded points and electrically connecting the metallic top shell;

the first and second grounded point positioned between the feeding point of the diversity antenna and the feeding point of the GPS antenna for improving isolation between each other.

9. The multiband antenna arrangement as described in claim 8 further comprises a WIFI antenna defining a first branch, a second branch separated from the first branch, a first feeding point disposed on the printed circuit board, a first elastic metallic plate electrically connecting the first branch with one grounded point selected from the plurality of grounded points, and a second elastic metallic plate electrically connecting the second branch with the first feeding point, the first branch serving as a parasitic element which is positioned between the second branch and the metallic shell for coupling each other.

10. The multiband antenna arrangement as described in claim 9, wherein the printed circuit board further includes a first extending portion, a second extending portion and a third extending portion far away from the first extending portion and the second extending portion, the second extending portion provided between the first extending portion and the third extending potion.

11. The multiband antenna arrangement as described in claim 10, wherein the first feeding point and the grounded point of the WIFI antenna provided on the third extending portion of the printed circuit board.

12. The multiband antenna arrangement as described in claim 11, wherein the feeding point of the diversity antenna is provided on the first extending portion of the printed circuit board, and the feeding point of the GPS antenna is provided on the third extending portion of the printed circuit board.

13. The multiband antenna arrangement as described in claim 12 further comprises a plurality of elastic metals corresponding to the first and second grounded point provided between the first and second grounded point and the metallic top shell for electrically connecting the metallic top shell.

14. The multiband antenna arrangement as described in claim 13, wherein plurality of elastic metals include four elastic metallic plates, one of the four elastic metals positioned on the second extending portion of the printed circuit board.

15. The multiband antenna arrangement as described in claim 14, wherein the metallic top shell includes a plane bottom and a sidewall extending upwardly from the plane bottom, the first branch of the WIFI antenna is positioned between the second branch of the WIFI antenna and the sidewall of the metallic shell.

16. The multiband antenna arrangement as described in claim 15, wherein the metallic shell further includes a metallic rear shell and an insulated intermediate shell sandwiched between the metallic top shell and the metallic rear shell.

* * * * *